United States Patent [19]

Dammann

[11] Patent Number: 4,563,799

[45] Date of Patent: Jan. 14, 1986

[54] AIR JET NOZZLE FOR TREATMENT OF YARNS

[75] Inventor: Peter Dammann, Remscheid, Fed. Rep. of Germany

[73] Assignee: Barmag Barmer Maschinenfabrik AG, Remscheid, Fed. Rep. of Germany

[21] Appl. No.: 539,929

[22] Filed: Oct. 7, 1983

[30] Foreign Application Priority Data

Oct. 8, 1982 [DE] Fed. Rep. of Germany ..... 3237273
Jun. 3, 1983 [DE] Fed. Rep. of Germany ..... 3320180

[51] Int. Cl.[4] ..... D02G 1/16

[52] U.S. Cl. ..... 28/272; 28/258; 28/274

[58] Field of Search ..... 28/271–276, 28/252–254, 258; 57/350–352, 279, 908

[56] References Cited

U.S. PATENT DOCUMENTS

| | | | |
|---|---|---|---|
| 2,812,850 | 11/1957 | Pape | 28/272 |
| 2,995,801 | 8/1961 | Cormier et al. | 28/271 |
| 3,031,770 | 5/1962 | Githens, Jr. et al. | 28/272 |
| 3,079,746 | 3/1963 | Field, Jr. . | |
| 3,167,847 | 2/1965 | Gonsalves | 28/272 |
| 3,199,339 | 8/1965 | Lipski | 28/272 |
| 3,220,082 | 11/1965 | Fletcher et al. . | |
| 3,823,449 | 7/1974 | Griset et al. | 28/272 |
| 4,097,975 | 7/1978 | Moeller | 28/271 |
| 4,148,116 | 4/1979 | Price | 28/273 |
| 4,254,610 | 3/1981 | Pierce et al. | 28/272 |
| 4,452,035 | 6/1984 | Rohner et al. | 28/274 |

FOREIGN PATENT DOCUMENTS

| | | | |
|---|---|---|---|
| 2840177 | 3/1980 | Fed. Rep. of Germany . | |
| 2913645 | 10/1980 | Fed. Rep. of Germany . | |
| 95906 | 2/1973 | German Democratic Rep. . | |
| 98118 | 6/1973 | German Democratic Rep. . | |
| 115417 | 10/1975 | German Democratic Rep. . | |
| 1155062 | 6/1969 | United Kingdom | 28/272 |

OTHER PUBLICATIONS

U.S.S.R. Document, #428045, 1 drawing, 2 pages.

*Primary Examiner*—Robert R. Mackey
*Assistant Examiner*—Joseph S. Machuga
*Attorney, Agent, or Firm*—Bell, Seltzer, Park & Gibson

[57] ABSTRACT

An air jet nozzle is disclosed which is adapted for imparting entanglements to continuous filament synthetic yarns. The nozzle includes a body member having a yarn passageway therethrough, and a transverse air inlet channel which communicates with the yarn passageway. A yarn threading slot is provided along the length of the yarn passageway for permitting a running yarn to be introduced laterally into the passageway, and a closure plate is mounted so as to be disposed in and substantially close the slot at the periphery of the yarn passageway. The closure plate serves to avoid any disruption of the air currents and thus the entangling process which may otherwise be caused by the presence of the yarn threading slot.

16 Claims, 6 Drawing Figures

AIR JET NOZZLE FOR TREATMENT OF YARNS

BACKGROUND OF THE INVENTION

The present invention relates to an air jet nozzle which is adapted for use in the treatment of running multifilament textile yarns, and wherein a running yarn composed of continuous synthetic filaments is subjected to a high velocity airstream to impart spaced entanglements to the yarn.

The process known in the textile industry as intermingling or entangling is commonly employed to improve the handling and coherence of zero twist continuous filament yarn, while permitting the expensive twisting step to be eliminated. The process is suitable for the treatment of flat as well as texturized synthetic yarns, including yarns composed of glass or polymeric filaments.

Prior art jet nozzles of this general type typically include a cylindrical yarn passageway and a radial air inlet channel communicating with the passageway. Compressed air under a pressure of about 6 bar is fed to the air inlet channel, and as the running yarn is advanced through the passageway, knot-like spaced apart entanglements are formed in the yarn. The distance between such entanglements, and their stability, are important quality features of the process, and factors which affect these quality features include the running yarn speed, and the denier of the yarn and of the filaments.

Some of the prior known nozzles of this type incorporate a yarn threading slot which opens into the yarn passageway, and extends along a plane which includes the axis of the yarn passageway. A yarn threading slot is considered essential in cases where the yarn is supplied continuously and at high speed, such as in spinning, spin-drawing, and spin-draw-texturing processes for synthetic yarns. The prior art jet nozzles which incorporate a threading slot typically comprise slotted inner and outer body members which are rotatable relative to each other. The members may be rotated to one relative position wherein the slots are in alignment to permit yarn thread up, or to another relative position wherein the slots are out of alignment. However, it has been found that with such a construction, yarns having a denier of more than about 1000 dtex, and which are supplied at a speed of at least about 2000 m/minute, particularly carpet yarns, cannot be properly entangled. The explanation for this deficiency is not totally understood, since the yarn threading slot is not positioned in the blowing direction of the air inlet, but it may be due to asymmetrical pressure gradients in the yarn passageway.

It accordingly is an object of the present invention to provide an air jet nozzle which is able to process continuous multifilament yarns so as to impart spaced entanglements to the yarns, and with the resulting yarns being adapted to run smoothly from their bobbins, under a uniform tension and without breakage.

It is also an object of the present invention to provide an air jet nozzle which is able to process such yarns in the described manner and such that the filaments of the resulting yarns have sufficient cohesion to permit subsequent processing, such as tufting.

It is a further object of the present invention to provide an air jet nozzle which may be readily threaded by means of a threading slot which does not disrupt the desired effect of the air jet during normal operation, and which is able to process yarns having a denier of more than about 1000 dtex and which are supplied at speeds greater than 2000 m/minute.

SUMMARY OF THE INVENTION

These and other objects and advantages of the present invention are achieved in the embodiment illustrated herein by the provision of an air jet nozzle which comprises a body member, a yarn passageway extending longitudinally through the body member, and an air inlet channel formed in the body member and communicating with the yarn passageway. The nozzle further includes a yarn threading slot communicating with the yarn passageway along the entire longitudinal length thereof, and a closure plate received in and substantially closing the slot at the periphery of the yarn passageway along at least that portion of the longitudinal length of the slot which is adjacent the air inlet channel.

The invention illustrates that the most simple geometry of the yarn passageway and air inlet channel, i.e., a cylindrical yarn passageway and a radial air inlet channel, offers the most favorable conditions for the practice of the entangling process. A first aspect of the optimization of the process according to the present invention involves mounting a closure plate in the threading slot, at least in the area of the air inlet channel, with the closure plate conforming to the width of the slot, and so that the side edge of the plate forms, or nearly forms, a continuation of the circumference of the yarn passageway in cross section. Preferably, the closure plate extends over the entire length of the slot through the nozzle. Also, the closure plate is preferably mounted on a support member and is adjustable with respect thereto. This support member is in turn releasably mounted to the body member and is guided for movement relative to the body member in the direction of the yarn threading slot.

In order to achieve a further optimization of the process, means are provided for preventing the yarn from coming into contact with the threading slot or with the closure plate during operation. For this purpose, an end plate may be positioned at one or both ends of the yarn passageway so as to cover the cross sectional area of the yarn passageway in the area of the yarn threading slot, and with the edge of the end plate overlying the passageway along a line which defines a secant to the circle defined by the yarn passageway in cross section. Each end plate is fixed to the support member which also mounts the closure plate, and during operation, each end plate is positioned so as to transversely overlie only that portion of the yarn passageway containing the threading slot. The secantial edge of each end plate constitutes a yarn guide in the area of the yarn threading slot when in the operative position, and each end plate is withdrawn with the support member from the area of the threading slot for purposes of thread-up of the yarn.

In the preferred embodiment of the invention, there is further provided a slotted yarn guide plate at one or both ends of the yarn passageway. The yarn guide plate is disposed transversely to the axis of the passageway, and the slot of the yarn guide plate extends in a direction parallel to the direction of the air inlet channel. The movement of the yarn within the air jet nozzle is restricted by the slot of the yarn guide plate to an axial plane where the radial air inlet channel is also positioned. It has been found that this construction is also desirable for nozzles which do not include a yarn threading slot and produces improved entanglement in many instances. The yarn guide plate is preferably mounted in such a manner that the slot of the plate may be displaced in a transverse direction. This feature permits an adaptation to variable process parameters. Also, the slot is preferably arranged precisely within the plane of the air inlet channel or closely adjacent that plane. In this manner, it is possible to compensate for any asymmetrical behavior of the nozzle by asymmetrically arranging the slot of the yarn guide plate.

In order to facilitate the thread-up of the yarn, each yarn guide plate may be moved, preferably pivoted, so that it may be withdrawn from the end of the air passageway. This movement may be performed by hand. Also, each yarn guide plate preferably is provided with a nose portion which projects into, or covers a funnel-shaped outer portion of the yarn threading slot. During insertion of the yarn into this funnel-shaped outer portion of the slot, the yarn presses against the nose of the guide plate, thereby urging the plate out of the area of the yarn threading slot, and the opening of the yarn passageway.

In a further embodiment of the invention, two essentially identical nozzles are arranged serially along the yarn path, thereby attaining an improvement which results from a summation of the entanglements. The number and distance between the entanglements depend on the process parameters of the first nozzle, as well as on the quality of the yarn, particularly the denier and number of filaments, and on the friction among the filaments.

The nozzles are preferably arranged at a distance relative to each other, which in any case is greater than the distance between the entanglements, and which is preferably less than twice the distance between the entanglements. The quality of the entanglements can thereby be favorably influenced.

BRIEF DESCRIPTION OF THE DRAWINGS

Some of the objects having been stated, other objects and advantages will appear as the description proceeds, when taken in connection with the accompanying drawings, in which.

DESCRIPTION OF THE PERFERRED EMBODIMENT

Referring more particularly to the drawings, an air jet nozzle embodying the present invention is disclosed in FIGS. 1–4 and which comprises a body member 1 having a cylindrical yarn passageway 2 extending longitudinally therethrough and defining an inner cylindrical wall. An air inlet channel 3 is formed in the body member, and radially communicates with the yarn passageway. More particularly, the channel 3 extends in a direction which perpendicularly intersects the axis of the yarn passageway. As will be appreciated, slight modifications of this arrangement, and in particular, modifications of the angle at which the air inlet channel is directed into the yarn passageway, may be made. It may also be possible to provide several air inlet channels. However, it should be emphasized that the optimization according to the invention has been achieved with a nozzle as described above. All other nozzle configurations produced less desirable results, with the only exception being the nozzle described in the German Offenlegungsschrift No. 29 13 645 which produced comparable results, however at the price of an increased air consumption.

Figure 1:
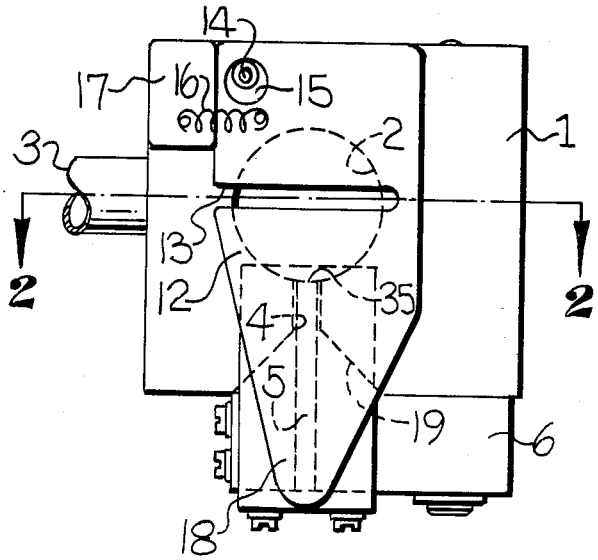
FIG. 1 is a side elevational view of an air jet nozzle embodying the features of the present invention.
Figure 2:
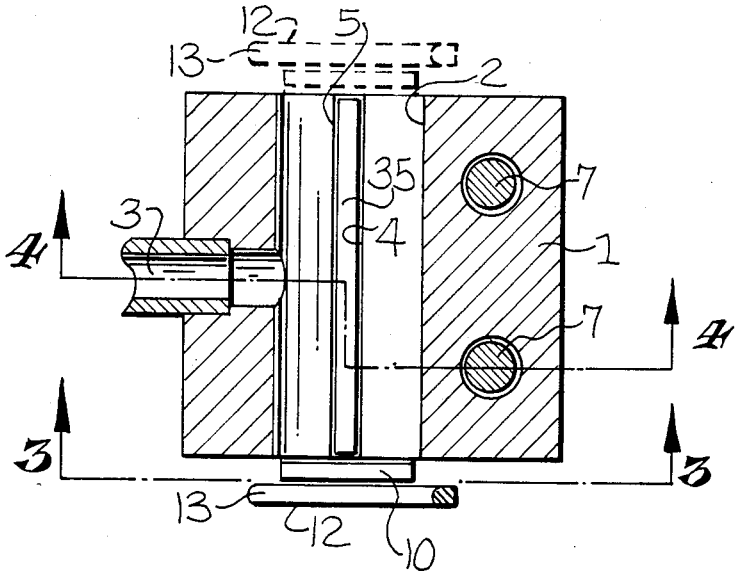
FIG. 2 is a sectional view taken substantially along the line 2—2 of FIG. 1.
Figure 3:
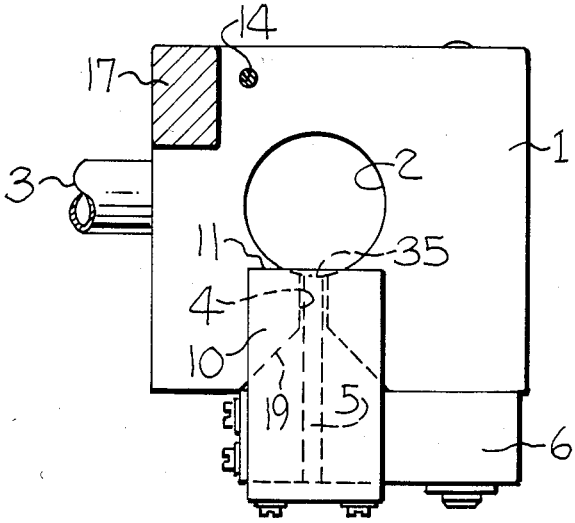
FIG. 3 is a view similar to FIG. 1, and taken along the line 3—3 of FIG. 2.
Figure 4:
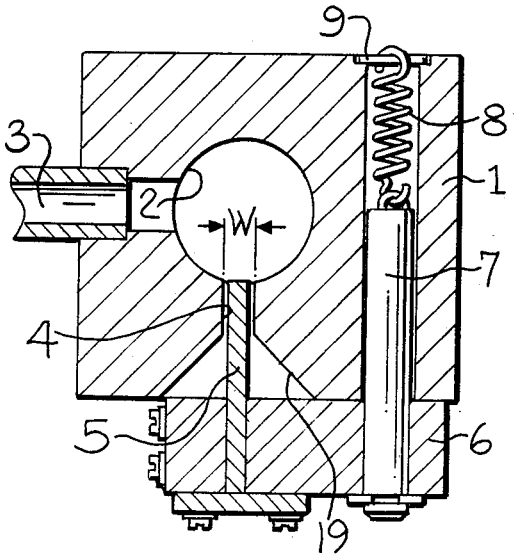
FIG. 4 is a sectional view taken substantially along the line 4—4 of FIG. 2.

To permit the lateral introduction of a running yarn into the passageway, the nozzle further includes a yarn threading slot 4 formed in the body member and communicating with the yarn passageway 2 along the entire longitudinal length thereof. Nozzles which are adapted for the treatment of yarns being supplied continuously and at high speeds, such as in the spinning, drawing and/or texturing processes, preferably are provided with a yarn threading slot. In the illustrated embodiment as best seen in FIG. 4, the slot 4 in cross section comprises an inner portion composed of parallel side walls having a predetermined width W therebetween, and so as to define a plane therebetween which includes the axis of the cylindrical passageway. Also, the slot includes an outer funnel-shaped portion 19 composed of opposing side walls which converge in a direction toward the yarn passageway in cross section. The slot as illustrated is positioned in an axial plane of the yarn passageway, which plane also lies perpendicularly to the direction of the air inlet channel. However, it may be possible to position the yarn threading slot and the air inlet channel at a different angle with respect to each other, or in the same axial plane on opposite sides of the yarn channel.

In accordance with the present invention, any tendency of the slot to impair the proper functioning of the nozzle is avoided by the provision of a closure plate 5 which is releasably mounted to the body member so as to be received in and substantially close the slot at the periphery of the yarn passageway 2 along at least that portion of the longitudinal length of the slot which is adjacent the air inlet channel 3. The closure plate 5 is fixed to a support member 6 and is disposed to lie in the plane defined by the side walls of the inner portion of the slot. Also, the plate has a straight side edge 35, and a thickness substantially corresponding to the predetermined width W of the inner portion of the slot. Further, the plate is positioned so that the straight side edge 35 forms a continuation of the inner cylindrical wall of the yarn passageway.

In order to prevent the yarn from contacting the side edge 35 of the closure plate 5, or the yarn threading slot 4, there is provided an end plate 10 which is mounted to the body member at one or both ends of the yarn passageway 2. Each such end plate 10 includes a straight upper edge 11, and is mounted to the support member 6 so that the plate 10 transversely overlies only that portion of the end of the yarn passageway containing the slot 4. Also, the upper edge 11 lies along a secant of the circle defined by the yarn passageway in cross section. The support member 6 is in turn releasably mounted to the body member 1 by means of a pair of guide posts 7 which are slideably mounted in respective bores of the body member. A spring 8 interconnects each post 7 with a pin 9 which is fixed to the body member 1 and serves to hold the support member 6 in its operative position as seen in FIG. 4. When it is desired to thread a yarn through the slot 4, the support member 6 is withdrawn from the body member until the closure plate 5 clears the slot 4.

As a further aspect of the illustrated embodiment of the invention, the nozzle is provided with a slotted yarn guide plate 12 which is mounted to the body member at one or both ends of the yarn passageway 2, with each such guide plate 12 transversely overlying the adjacent end plate 10 and the adjacent end of the yarn passageway 2. Each guide plate 12 is provided with an elongate slot 13 which is aligned with the central portion of the passageway and so that the axis of the passageway passes therethrough. Further, the slot 13 in each guide plate extends in a direction parallel to the direction of the air inlet channel 3.

Each slotted yarn guide plate 12 is mounted to the body member so that it may be pivoted about a pivotal axis 14 which is parallel to the axis of the passageway. Further, each plate is biased by a spring 16 toward a stop 17 which defines its operative position. Each guide plate 12 includes a nose portion 18 having opposite side edges which diverge in a direction toward the yarn passageway 2 in cross section, and with the nose portion overlying the outer funnel-shaped portion 19 of the threading slot 4 in cross section. Thus when the support member 6 and end plates 10 are withdrawn from the funnel-shaped portion of the slot 4, the yarn may slide into the slot 4 and press against the nose 18, and the guide plate 12 is thereby pivoted until it clears the slot 4 and the yarn passageway 2. The yarn may then slide along the front edge of the yarn guide 12 and into the slot 13.

Each slotted yarn guide plate 12 is adjustably mounted to the body member so as to be displaceable in a direction perpendicular to the slot 13. For this purpose, there is provided in the illustrated embodiment a rotatable eccentric 15 which serves as a bearing for pivoting the plate about the pivotal axis 14. It has been found that a radial displacement of the plate by only about 1/10 mm permits the nozzle to be adapted to varying yarn deniers and yarn running speeds or other process parameters. Also, arranging two essentially identical nozzles serially in the yarn path has also proven to be advantageous.

Figure 5:
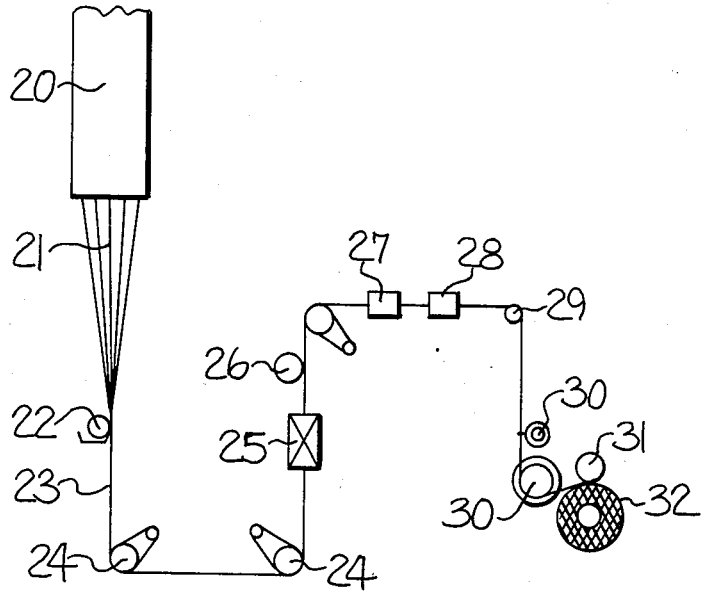
FIG. 5 is a schematic illustration of a spin-draw-texturing process for polyamide yarns with the arrangement of the air jet nozzles according to one embodiment of the present invention.

The operation of the described embodiment of the invention will now be described with reference to FIGS. 5 and 6. FIG. 5 illustrates the steps of a spinning process embodying the invention. The multifilaments 21 are supplied from the spinnerette 20, and the filaments are joined to form a yarn 23 which is treated with an appropriate fluid by the preparation roller 22. The yarn is then drawn between the draw rollers 24 and then passes through a steam texturizing nozzle 25 and a cooling drum 26. After passing another draw roll, the yarn is guided through a first entangling nozzle 27 and a second entangling nozzle 28, and thereafter it is deflected over the yarn guide 29 and guided to the traversing device 30, which consists of a traversing yarn guide and a grooved roller. Finally, the yarn is wound onto bobbin 32 which is driven by a drive roll 31.

Figure 6:
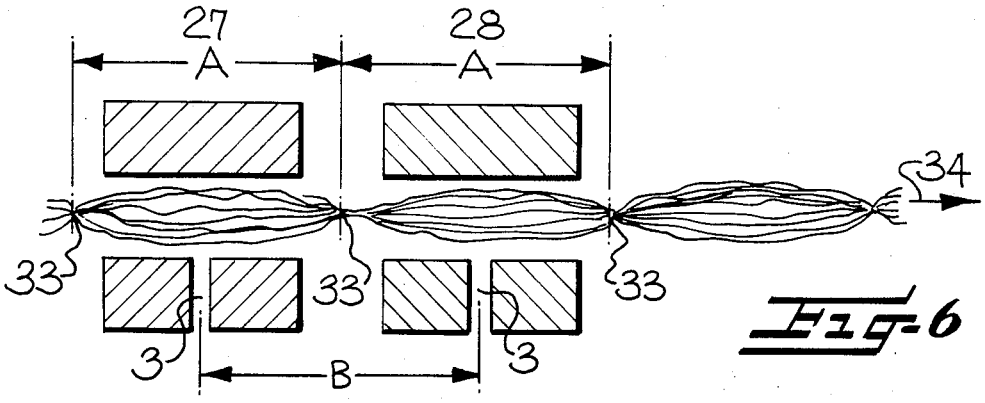
FIG. 6 is a schematic illustration of an entangled yarn and two air jet nozzles in series.

As illustrated in FIG. 6, the yarn is advanced in the direction 34, and knot-like entanglements 33 are imparted to the running yarn in the nozzle 27 with a distance A therebetween. Although depending somewhat on various yarn parameters and process parameters, the distance A is essentially constant and cannot be changed. Between two knot-like entanglements 33, the individual filaments run essentially parallel with respect to each other. The stability of the entanglements and the distances between them are important factors for the quality of the entangling procedure. Particularly, the ability of the yarn to be drawn from its bobbin at a high speed, with yarn tension peaks and yarn breakage being avoided, depends on the distance A and the stability of the entanglements. Contrary to all expectations, it has been found that the distance A cannot, or can only slightly, be influenced by the number and the arrangement of the several air inlet channels 3 or by several nozzles being arranged serially one behind the other. In particular, it has been found that the treatment of the yarn by means of two nozzles is effective only if these nozzles are arranged at a minimum distance with respect to each other. This minimum distance is essentially equal to the distance A between the entanglements.

It has also been found that the maximum limit for the distance between two nozzles is not distinct. Favorable results however have been achieved, when the distance A between two nozzles is smaller than twice the distance A between the entanglements.

The second nozzle 28, viewed in the direction of the running yarn, noticeably influences the stability of the entanglements. The entanglements are tighter, and their distribution is more uniform, when the number of entanglements per unit of length is increased. The second nozzle may be smaller than the first nozzle and may therefore consume less air.

In the drawings and specification, there has been set forth preferred embodiments of the invention, and although specific terms are employed, they are used in a generic and descriptive sense only and not for purposes of limitation.

I claim:

1. An air jet nozzle adapted for the entanglement of a running multifilament yarn and the like, and comprising a body member, a yarn passageway extending longitudinally through said body member, an air inlet channel formed in said body member and transversely communicating with said yarn passageway, a yarn threading slot formed in said body member and communicating with said yarn passageway along the entire longitudinal length thereof, closure means releasably mounted to said body member so as to be received in and substantially close said slot at the periphery of said yarn passageway along at least that portion of the longitudinal length of said slot which is adjacent said air inlet channel, an end plate mounted to said body member at at least one end of said yarn passageway, with such end plate transversely overlying only that portion of the end of the yarn passageway containing said yarn threading slot, a yarn guide plate mounted to said body member at at least one end of said yarn passageway, with such guide plate transversely overlying the associated end of said yarn passageway, and with such guide plate including an elongate slot which is axially aligned with the central portion of said passageway, and means mounting said yarn guide plate to said body member so as to permit adjustment in a direction perpendicular to the direction of said slot in such guide plate.

2. The air jet nozzle as defined in claim 1 wherein said yarn passageway is generally cylindrical, said yarn threading slot defines a plane which includes the axis of said cylindrical yarn passageway, and said air inlet channel extends in a direction which perpendicularly intersects said plane defined by said slot.

3. The air jet nozzle as defined in claim 2 wherein said air inlet channel extends in a direction which also perpendicularly intersects the axis of said cylindrical yarn passageway.

4. An air jet nozzle adapted for the entanglement of a running multifilament yarn and the like, and comprising a body member, a yarn passageway extending longitudinally through said body member, an air inlet channel formed in said body member and transversely communicating with said yarn passageway, a yarn threading slot formed in said body member and communicating with said yarn passageway along the entire longitudinal length thereof, closure means releasably mounted to said body member so as to be received in and substantially close said slot at the periphery of said yarn passageway along at least that portion of the longitudinal length of said slot which is adjacent said air inlet channel, a yarn guide plate mounted to said body member at at least one end of said yarn passageway, with such guide plate transversely overlying the associated end of said yarn passageway, and with such guide plate including an elongate slot having parallel side edges and which is axially aligned with the central portion of said passageway, and means mounting said yarn guide plate to said body member so as to permit adjustment in a direction perpendicular to the direction of said slot in such guide plate and so that the slot in such guide plate may be adjustably positioned within a range which includes the central portion of said passageway.

5. An air jet nozzle adapted for the entanglement of a running multifilament yarn and the like, and comprising a body member, a cylindrical yarn passageway extending longitudinally through said body member and defining an inner cylindrical wall, an air inlet channel formed in said body member and radially communicating with said yarn passageway, with said air inlet channel extending in a direction which perpendicularly intersects the axis of said yarn passageway, a yarn threading slot formed in said body member and communicating with said yarn passageway along the entire longitudinal length thereof, said slot including an inner portion disposed immediately adjacent said inner wall of said yarn passageway and comprising spaced apart parallel side walls having a predetermined width therebetween and so as to define a plane therebetween which includes the axis of said cylindrical passageway, a closure plate having a straight side edge and a thickness substantially corresponding to said predetermined width of said slot, means releasably mounting said closure plate in said slot of said body member with said straight side edge being substantially aligned with said inner wall of said passageway along at least that portion of the longitudinal length of said slot which is adjacent said air inlet channel, a yarn guide plate mounted to said body member at at least one end of said yarn passageway, with such guide plate transversely overlying the associated end of said yarn passageway and including an elongated slot which is aligned with the passageway so that the axis of the passageway passes therethrough, and means mounting said yarn guide plate to said body member so as to permit adjustment in a direction perpendicular to the direction of said slot of such guide plate and pivotal movement about an axis parallel to the axis of said yarn passageway so as to permit such guide plate to be selectively withdrawn from its position overlying the associated end of said yarn passageway.

6. An air jet nozzle adapted for the entanglement of a running multifilament yarn and the like, and comprising a body member, a cylindrical yarn passageway extending through said body member and defining an inner cylindrical wall, an air inlet channel formed in said body member and radially communicating with said yarn passageway, a yarn guide plate mounted to said body member at at least one end of said yarn passageway, with such guide plate transversely overlying the associated end of said yarn passageway and including an elongate slot which is aligned with the passageway so that the axis of the passageway passes therethrough, and with said slot extending in a direction parallel to the direction of said air inlet channel, and means mounting said yarn guide plate to said body member so as to permit adjustment in a direction perpendicular to the direction of said slot in such guide plate, said mounting means including means permitting pivotal movement of said guide plate about an axis parallel to the axis of said yarn passageway so as to permit such guide plate to be selectively withdrawn from its position overlying the associated end of said yarn passageway.

7. The air jet nozzle as defined in claim 6 further comprising a yarn threading slot formed in said body member and communicating with said yarn passageway along the entire longitudinal length thereof.

8. The air jet nozzle as defined in claim 7 wherein said yarn threading slot includes an outer funnel-shaped portion which comprises opposing side walls which converge in a direction toward said yarn passageway in cross section, and said yarn guide plate includes a nose portion overlying said outer funnel-shaped portion of said slot in cross section.

9. The air jet nozzle as defined in claim 8 further comprising closure means releasably mounted to said body member so as to be received in and substantially close said slot at the periphery of said yarn passageway along at least that portion of the longitudinal length of said slot which is adjacent said air inlet channel.

10. The air jet nozzle as defined in claim 7 further comprising closure means releasably mounted to said body member so as to received in and substantially close said slot at the periphery of said yarn passageway along at least that portion of the longitudinal length of said slot which is adjacent said air inlet channel.

11. An air jet nozzle adapted for the entanglement of a running multifilament yarn and the like, and comprising a body member, a yarn passageway extending longitudinally through said body member, an air inlet channel formed in said body member and transversely communicating with said yarn passageway, a yarn threading slot formed in said body member and communicating with said yarn passageway along the entire longitudinal length thereof, closure means releasably mounted to said body member so as to be received in and substantially close said slot at the periphery of said yarn passageway along at least that portion of the longitudinal length of said slot which is adjacent said air inlet channel, an end plate mounted to said body member at at least one end of said yarn passageway, with such end plate transversely overlying only that portion of the end of the yarn passageway containing said yarn threading slot, and a support member releasably mounted to said body member, and wherein said end plate and said closure means are mounted to said support member.

12. An air jet nozzle adapted for subjecting a running multifilament yarn to a high velocity airstream to impart entanglements and the like to the yarn, and comprising a body member, a cylindrical yarn passageway extending longitudinally through said body member and defining an inner cylindrical wall, with the diameter of the passageway being substantially uniform along its longitudinal length, an air inlet channel formed in said body member and radially communicating with said yarn passageway, a yarn threading slot formed in said body member and communicating with said yarn passageway along the entire longitudinal length thereof, said slot including an inner portion disposed immediately adjacent said inner wall of said yarn passageway and comprising spaced apart parallel side walls having a predetermined width therebetween which is substantially less than the diameter of said cylindrical yarn passageway, a closure plate having a straight side edge and a thickness substantially corresponding to said predetermined width of said slot, and means releasably mounting said closure plate in said slot of said body member for radial movement between an operative position wherein said straight side edge is substantially aligned with said inner wall of said passageway along at least that portion of the longitudinal length of said slot which is adjacent said air inlet channel, and a radially withdrawn thread-up position.

13. The air jet nozzle as defined in claim 12 further comprising an end plate mounted to said body member at at least one end of said yarn passageway, with such end plate transversely overlying only that portion of the end of the yarn passageway containing said yarn threading slot, and with said end plate having a straight edge which lies along a secant of the circle defined by the yarn passageway in cross section.

14. The air jet nozzle as defined in claim 12 further comprising a yarn guide plate mounted to said body member at at least one end of said yarn passageway, with said guide plate transversely overlying the associated end of said yarn passageway, and with said guide plate including an elongated slot which is axially aligned with the central portion of said passageway.

15. The air jet nozzle as defined in claim 14 wherein said slot of said yarn guide plate extends in a direction parallel to the direction of said air inlet channel.

16. The air jet nozzle as defined in claim 14 further comprising means mounting said yarn guide plate to said body member so as to permit pivotal movement of said guide plate about an axis parallel to the axis of said yarn passageway so as to permit said guide plate to be selectively withdrawn from its position overlying the associated end of said yarn passageway.

* * * * *